US007449642B1

(12) United States Patent
Wu et al.

(10) Patent No.: US 7,449,642 B1
(45) Date of Patent: Nov. 11, 2008

(54) METALLIC KEYPAD PANEL ASSEMBLY HAVING RIPPLE LUSTER

(75) Inventors: Che-Tung Wu, Taoyuan (TW); Chih-Ho Hsu, Taoyuan (TW); Kai-Jie Tsao, Taoyuan (TW)

(73) Assignee: Ichia Technologies, Inc., Taoyuan (TW)

( * ) Notice: Subject to any disclaimer, the term of this patent is extended or adjusted under 35 U.S.C. 154(b) by 0 days.

(21) Appl. No.: 11/946,610

(22) Filed: Nov. 28, 2007

(30) Foreign Application Priority Data

Nov. 7, 2007 (TW) ..... 96218756 U

(51) Int. Cl.
*H01H 9/26* (2006.01)
*H01H 13/72* (2006.01)
*H01H 13/76* (2006.01)

(52) U.S. Cl. ..... 200/5 A; 200/302.2

(58) Field of Classification Search ..... 200/5 A
See application file for complete search history.

(56) References Cited

U.S. PATENT DOCUMENTS 4,811,175 A * 3/1989 DeSmet ..... 362/95
6,382,855 B1 * 5/2002 Katori ..... 400/494
6,573,463 B2 * 6/2003 Ono ..... 200/5 A
7,070,349 B2 * 7/2006 Dombrowski et al. ..... 400/490

FOREIGN PATENT DOCUMENTS

JP 2007-115633 5/2007

* cited by examiner

*Primary Examiner*—Elvin G Enad
*Assistant Examiner*—Lheiren Mae A Anglo

(57) ABSTRACT

A metallic keypad panel assembly having a ripple luster includes a thin plate, a displaying layer, an elastic layer, an adhesive layer, a metallic keypad panel, an electroplated layer and a pattern layer. One side surface of the thin plate is printed with a film to form a displaying layer. The elastic layer is adhered on one side surface of the displaying layer and has a carrier thereon. One side surface of the carrier is provided thereon with a plurality of protrusions. The metallic keypad panel is disposed on one side surface of the thin plate and has a plate body thereon. The plate body is provided thereon with a first hollowed portion and a second hollowed portion. The first hollowed portion defines a pressing region of a keypad, and the second hollowed portion is set as an icon on the surface of the pressing region. The electroplated layer is provided on one side surface of the metallic keypad panel and penetrates into the first hollowed portion and the second hollowed portion. The pattern layer is provided on one side surface of the electroplated layer to seal and fill the first hollowed portion and the second hollowed portion. When external light illuminates the pattern layer of the metallic keypad panel, the pattern layer generates a reflective effect of a ripple luster.

20 Claims, 8 Drawing Sheets

METALLIC KEYPAD PANEL ASSEMBLY HAVING RIPPLE LUSTER

BACKGROUND OF THE INVENTION

1. Field of the Invention

The present invention relates to a keypad panel, and in particular to a metallic keypad panel assembly.

2. Description of Prior Art

Keypad panel has become a necessary hardware for a portable electronic device. The surface of the keypad on the keypad panel is provided with numerals, characters, phonetic symbols, roots for an input method and various functional icons, so that a user can input data according to the icon displayed on the surface of the keypad or perform various functions of the portable electronic device. Therefore, for a portable electronic device, the keypad panel is a very important input means.

For example, a conventional metallic keypad panel on a portable electronic device is shown in FIGS. 1(*a*) and 1(*b*) (Japanese Laid-Open Patent Publication No. 2007-115633). In manufacturing the metallic keypad panel 10*a* disclosed in FIG. 1, a metallic plate 1*a* is prepared first. Then, a first etching process is applied to the metallic plate 1*a*, thereby forming hollowed portions 2*a* having characters, numerals and marks. After etching the hollowed portions 2*a*, a second etching process is applied to one side surface of the metallic plate 1*a*. After the second etching process, one side surface of the metallic plate 1*a* is formed thereon with a cross-like recessed portion 2*b*. Then, the metallic plate 1*a* is disposed in a mold. A resin is injected into the mold, so that the resin can fill the hollowed portions 2*a* and the cross-like recessed portion 2*b*. The cross-like recessed portion 2*b* allows the resin to be combined on the metallic plate 1*a* firmly, thereby forming a resin layer 3*a*. After the metallic plate 1*a* is combined with the resin layer 3*a*, the metallic plate 1*a* is cut to form keypad caps 11*a*. Then, one side surface of the resin layer 3*a* is printed with a printing layer 4*a*. An adhesive layer 5*a* is applied on the printing layer 4*a*. The resin layer 3*a* is adhered on elastic bodies 7*a* of a base 6*a*, so that a protrusion 71*a* of the elastic body 7*a* can press against a metal dome 8.

In manufacturing the above-mentioned metallic keypad panel 10*a*, since two or more etching processes should be applied to the metallic plate 1*a*, more work hours and a large number of processes are necessary. Further, a gap is formed between each keypad cap 11*a*, and the gap may be filled by dusts or penetrated by liquid easily. As a result, the metallic keypad caps 11*a* cannot be pressed smoothly or an internal short circuit may occur. Further, one side surface of the metallic plate 1*a* does not provide any reflective effect of a particular luster. Therefore, the external appearance and the overall visual effect of the metallic keypad panel 10*a* are dull.

SUMMARY OF THE INVENTION

In view of the above drawbacks, the present invention is to provide a novel and simple method for manufacturing a metallic keypad panel that allows the metallic keypad panel to be manufactured easily and also makes the surface of the metallic keypad panel to have a reflective effect of a ripple luster.

The present invention is to provide a metallic keypad panel assembly having a ripple luster, which includes a thin plate, a displaying layer, an elastic layer, an adhesive layer, a metallic keypad panel, an electroplated layer and a pattern layer. One side surface of the thin plate is printed with a film to form displaying layer. The displaying layer is constituted of different colors. The elastic layer is adhered on one side surface of the displaying layer and has a carrier thereon. One side surface of the carrier is provided with a plurality of protrusions. The adhesive layer is applied on one side surface of the thin plate, thereby binding the metallic keypad panel. The metallic keypad panel is provided on one side surface of the adhesive layer and has a plate body thereon. The plate body is provided thereon with a first hollowed portion and a second hollowed portion. The first hollowed portion encircles a pressing region of a keypad via lines, and the second hollowed portion is set as an icon on the surface of the pressing region. The electroplated layer is provided on one side surface of the metallic keypad panel and penetrates into the first hollowed portion and the second hollowed portion. The pattern layer is provided on one side surface of the electroplated layer to seal and fill the first hollowed portion and the second hollowed portion.

DETAILED DESCRIPTION OF THE INVENTION

The detailed description and the technical contents of the present invention will be explained with reference to the accompanying drawings.

Figure 1A:
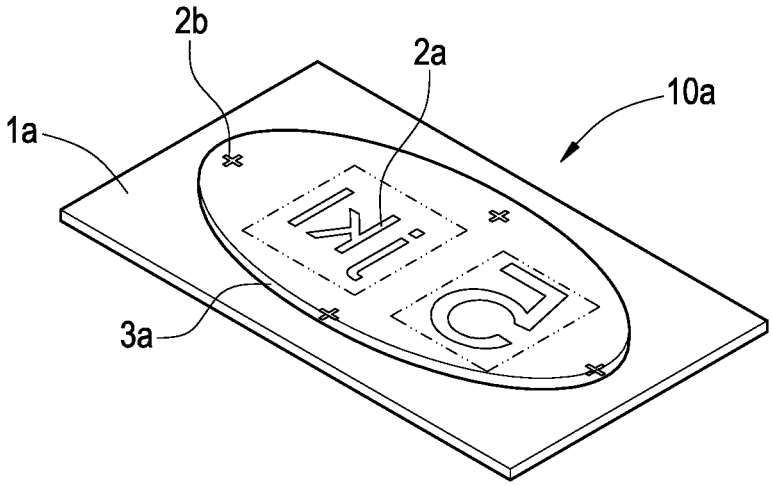
FIG.1a PRIOR ART
FIGS. 1(*a*) and 1(*b*) are schematic views showing a structure of a traditional metallic keypad panel.
Figure 1B:
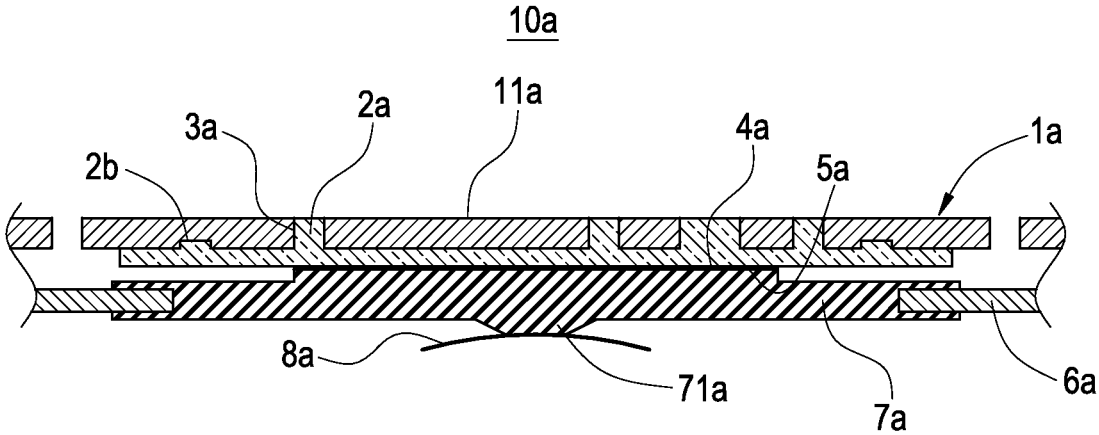
FIG.1b PRIOR ART
Figure 2:
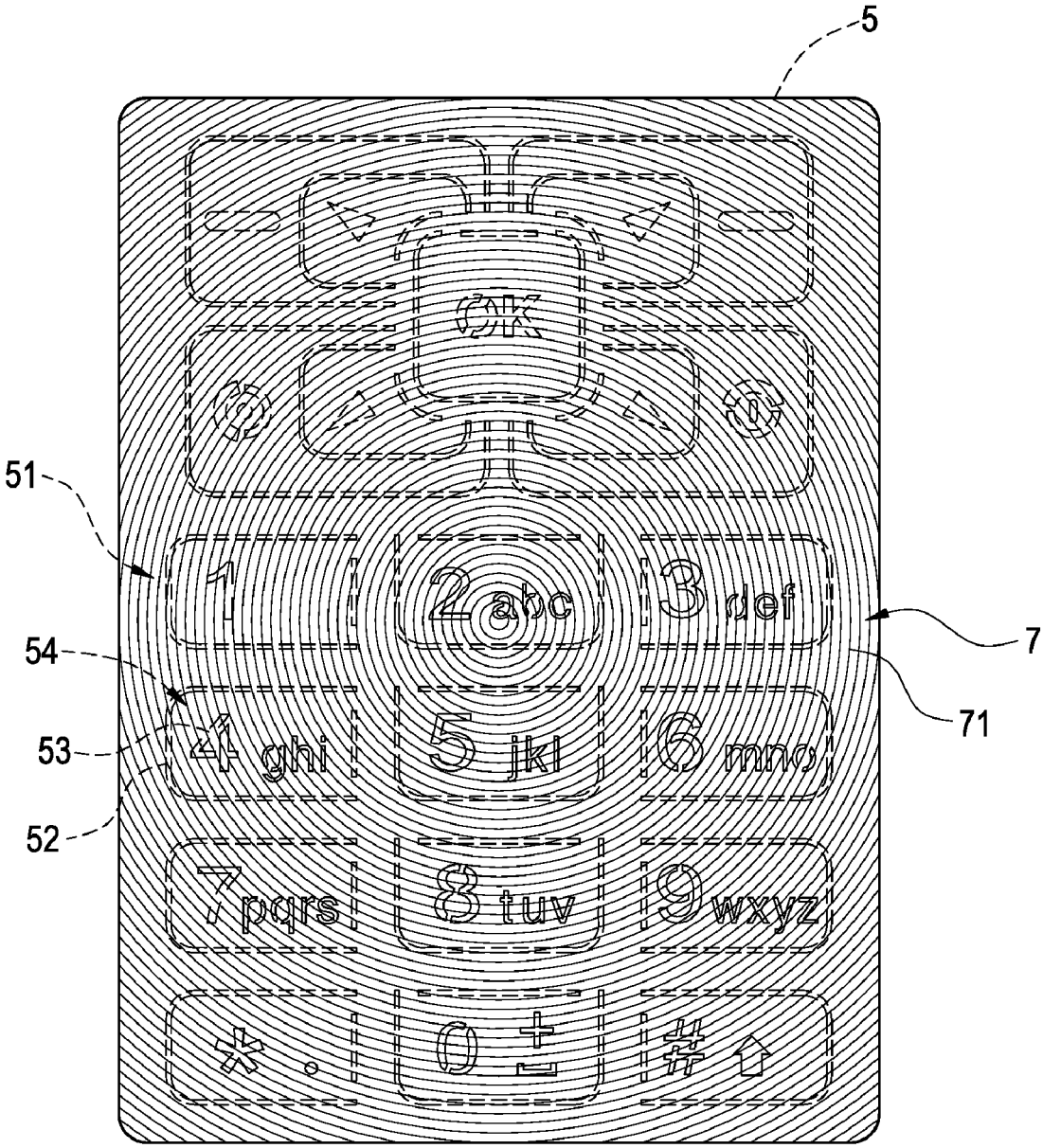
FIG. 2 is a schematic view showing the external appearance of the metallic keypad panel of the present invention.
Figure 3:
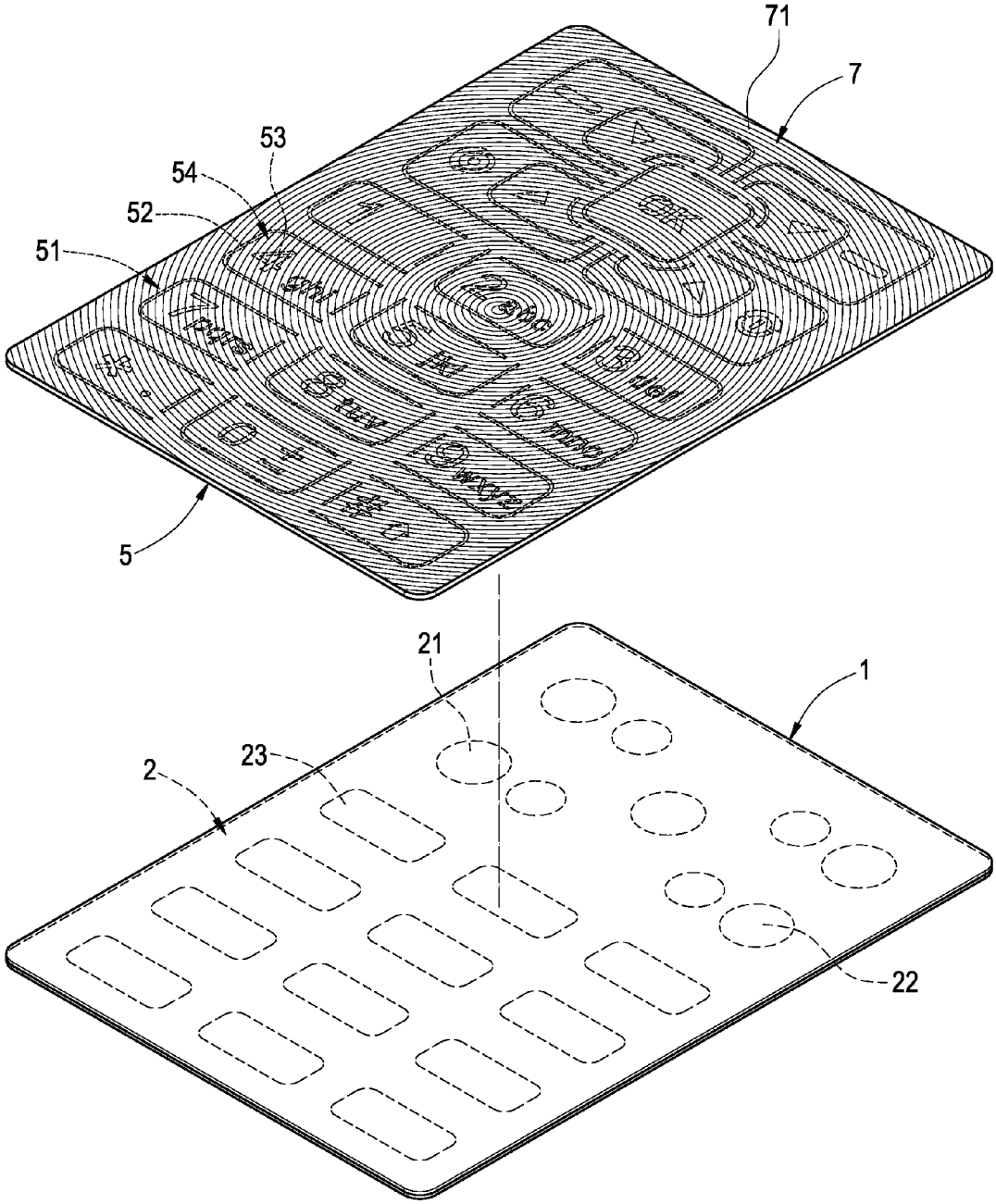
FIG. 3 is an exploded view showing the metallic keypad panel of the present invention.
Figure 4:
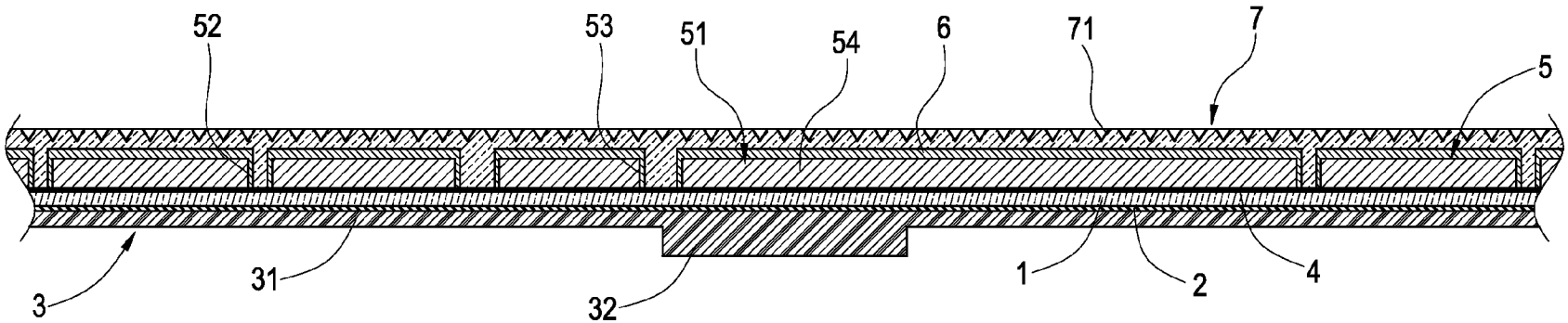
FIG. 4 is a side cross-sectional view showing the metallic keypad panel of the present invention.

FIG. 2 is a schematic view showing the external appearance of the metallic keypad panel of the present invention. FIG. 3 and FIG. 4 are an exploded view and a side cross-sectional view showing the metallic keypad panel of the present invention respectively. As shown in these figures, the present invention provides a metallic keypad panel assembly having a ripple luster, which includes a thin plate 1, a displaying layer 2, an elastic layer 3, an adhesive layer 4, a metallic keypad panel 5, an electroplated layer 6 and a pattern layer 7.

The thin plate 1 is made of either polyethylene terephthalate (PET) or polycarbonate (PC).

The displaying layer 2 is printed as a film on one side surface of the thin plate 1. The displaying layer 2 is constituted of different colors, such as green 21, red 22, white 23 or the like.

The elastic layer 3 is adhered on one side surface of the displaying layer 2 and is made of a rubber material. The elastic layer 3 has a carrier 31 thereon. One side surface of the carrier 31 is provided thereon with a plurality of protrusions 32.

The adhesive layer 4 is applied on one side surface of the thin plate 1 for binding the metallic keypad panel 5.

The metallic keypad panel 5 is provided on one side surface of the adhesive layer 4. The metallic keypad panel 5 is made of stainless steel (SUS) or Al—Mg alloy and has a thin plate body 51 thereon. The plate body 51 is provided thereon with a first hollowed portion 52 and a second hollowed portion 53. The first hollowed portion 52 encircles a pressing region 54 of a keypad via lines, and the second hollowed portion 53 is set as an icon on the surface of the pressing region 54. The icon includes any one of numerals (0 to 9), characters (A to Z), special symbols (e.g., "#", "*", "." etc.), dialing icon, ending icon and navigational symbols.

The electroplated layer 6 is provided on one side surface of the metallic keypad panel 3 and penetrates into the first hollowed portion 52 and the second hollowed portion 53. The electroplated layer is made of a metallic material such as nickel.

The pattern layer 7 is provided on one side surface of the electroplated layer 6 to fill the first hollowed portion 52 and the second hollowed portion 53. The pattern layer 7 is made of plastic materials such as thermoplastic polyurethane (TPU) or thermoplastic elastomer (TPE). The surface of the pattern layer 7 has a pattern 71 of a ripple luster, such as a spinning, straight lines or Archimedean screw. Further, the pattern layer 7 also forms a protective layer for the metallic keypad panel 5.

Figure 5:
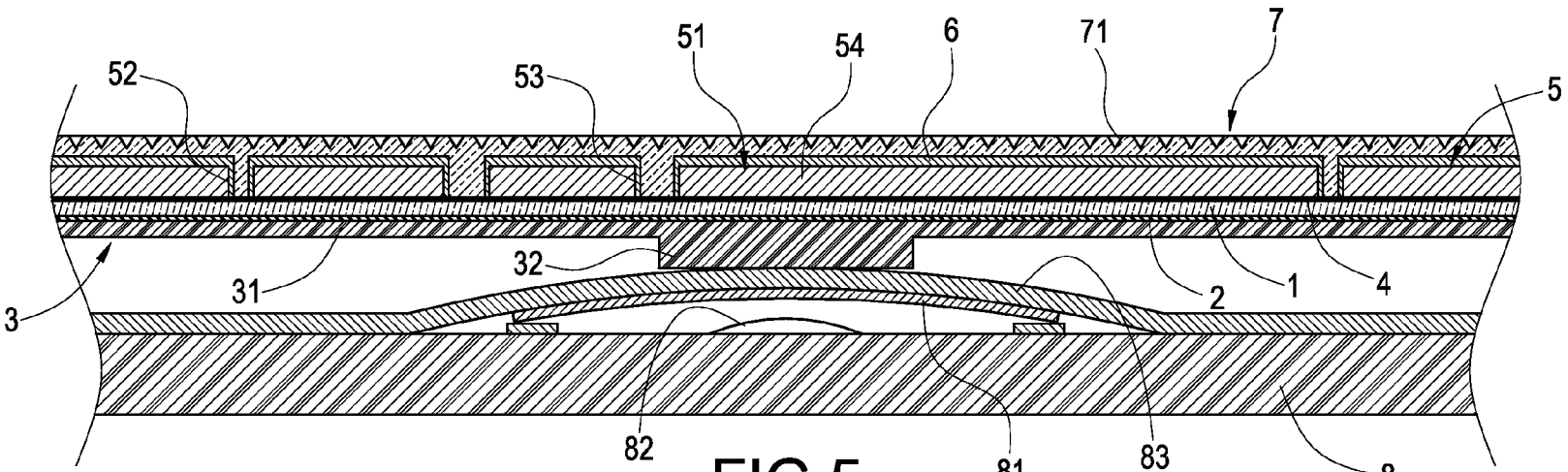
FIG. 5 is a schematic view showing the metallic keypad panel of the present invention being used in a circuit board of an electronic device.
Figure 6:
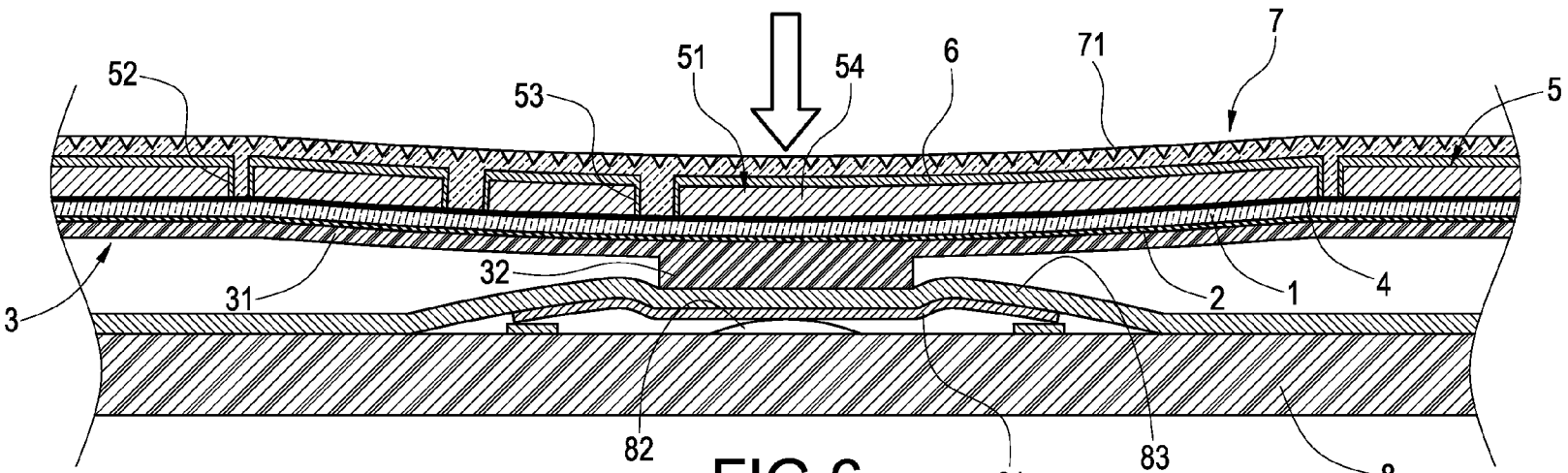
FIG. 6 is a schematic view showing an operating state in FIG. 5.

FIG. 5 is a schematic view showing the metallic keypad panel of the present invention being used in a circuit board of an electronic device, and FIG. 6 is a schematic view showing an operating state in FIG. 5. As shown in these figures, when the metallic keypad panel assembly of the present invention is arranged on a flexible printed circuit board of an electronic device, the circuit board 8 is provided with a plurality of metal domes 81. Each metal dome 81 corresponds to a contacting point 82 on the circuit board 8. Then, a dome sheet 83 is attached on one side surface of the circuit board 8, so that the metal dome 81 is disposed between the circuit board 8 and the dome sheet 83.

When the pressing region 54 of the metallic keypad panel 5 is pressed by an external force, the pressing of the pressing region 54 causes the protrusion 31 of the elastic layer 3 to press against one side surface of the dome sheet 83 on the circuit board 8. As a result, the metal dome 81 is deformed to contact the contacting point 82 of the circuit board 8, thereby generating a conductive signal output.

When the surface of the pressing region 54 is not pressed by an external force, the elasticity of the materials of the metallic keypad panel 5 and the elastic layer 3 allows the pressing region 54 to rise automatically, thereby returning to its original state.

Further, when a backlight model (not shown) arranged within the electronic device is lighted up, the color displayed by the displaying layer 2 makes the pressing region 54 to exhibit various colors.

Figure 7:
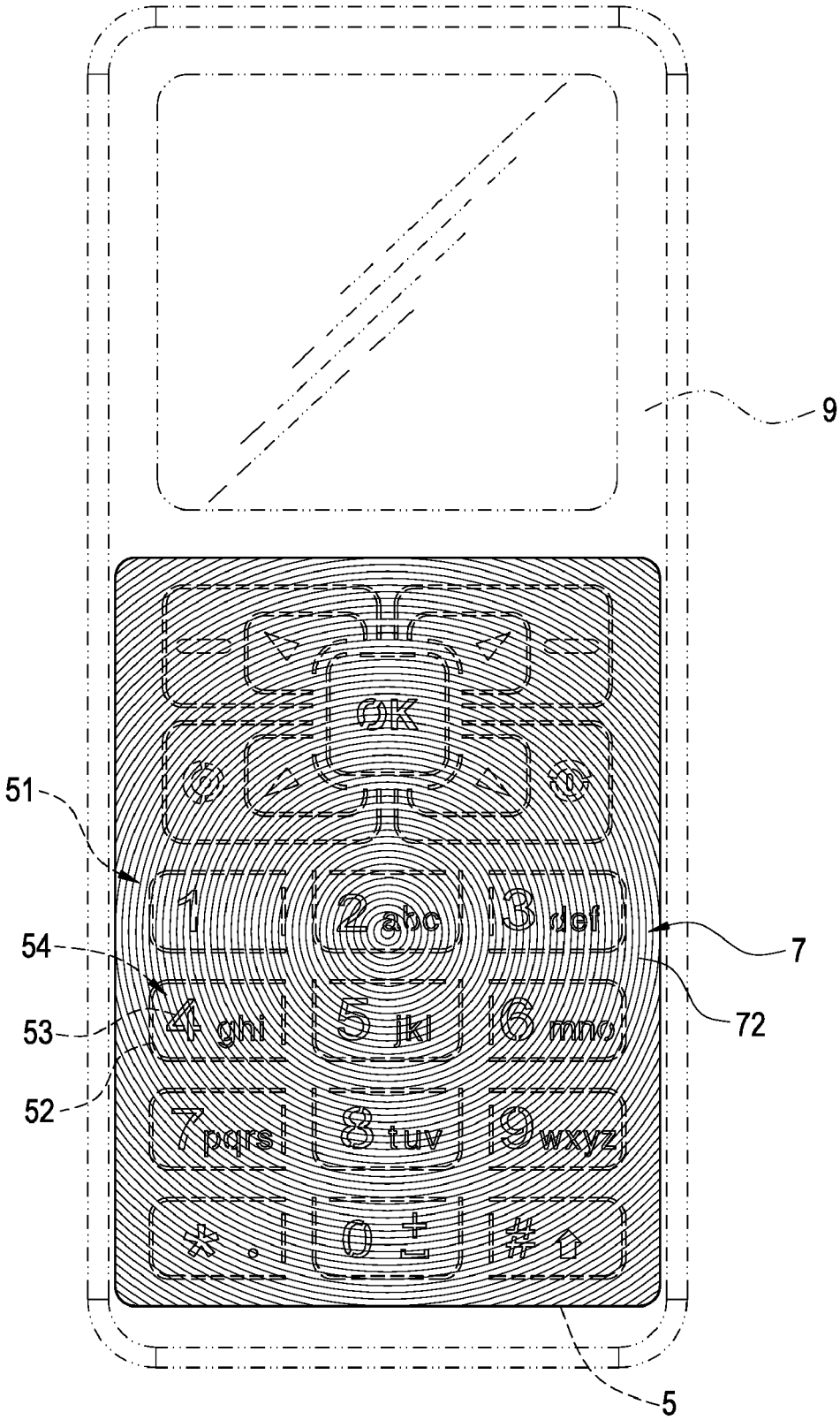
FIG. 7 is a schematic view showing the metallic keypad panel of the present invention being used in a mobile phone.

With reference to FIG. 7, it is a schematic view showing the metallic keypad panel of the present invention being used in a mobile phone. As shown in this figure, after the metallic keypad panel 5 of the present invention is manufactured completely, it can be applied to a mobile phone 9. When the light illuminates the pattern layer 7 of the metallic keypad panel 5, the pattern layer 7 generates a reflective effect of a ripple luster, thereby increasing the aesthetic feeling of the mobile phone 9. Further, the pattern layer 7 can protect the surface of the metallic keypad panel 5 from suffering damage due to external rigid objects.

Figure 8:
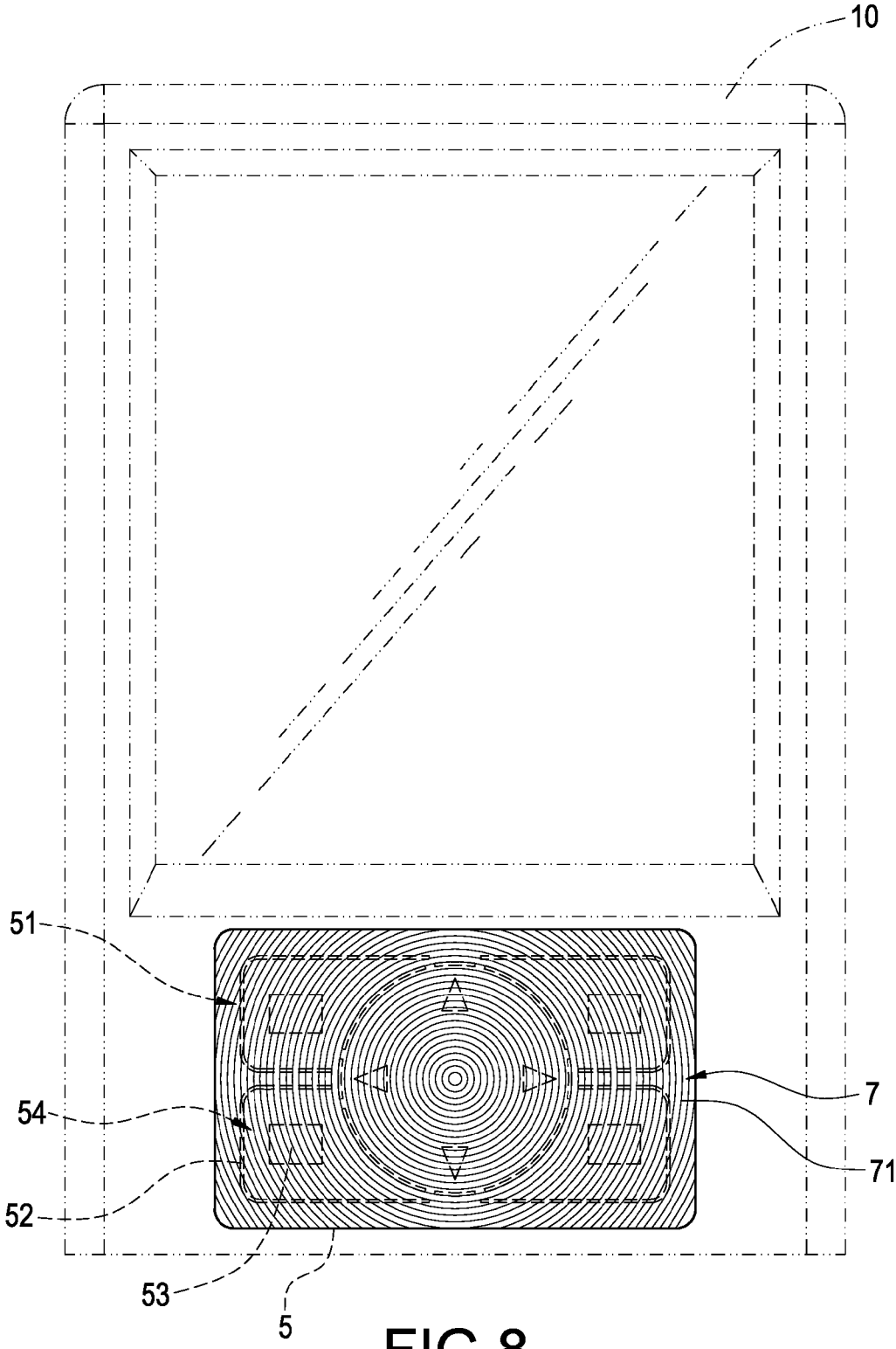
FIG. 8 is a schematic view showing the metallic keypad panel of the present invention being used in a personal digital assistant (PDA)

With reference to FIG. 8, it is a schematic view showing the metallic keypad panel of the present invention being used in a personal digital assistant (PDA). As shown in this figure, after the metallic keypad panel 5 of the present invention is manufactured completely, in addition to the mobile phone 9, it can be applied to a personal digital assistant (PDA) 10. When the light illuminates the pattern layer 7 of the metallic keypad panel 5, the pattern layer 7 generates a reflective effect of a ripple luster, thereby increasing the aesthetic feeling of the personal digital assistant (PDA) 10.

Figure 9:
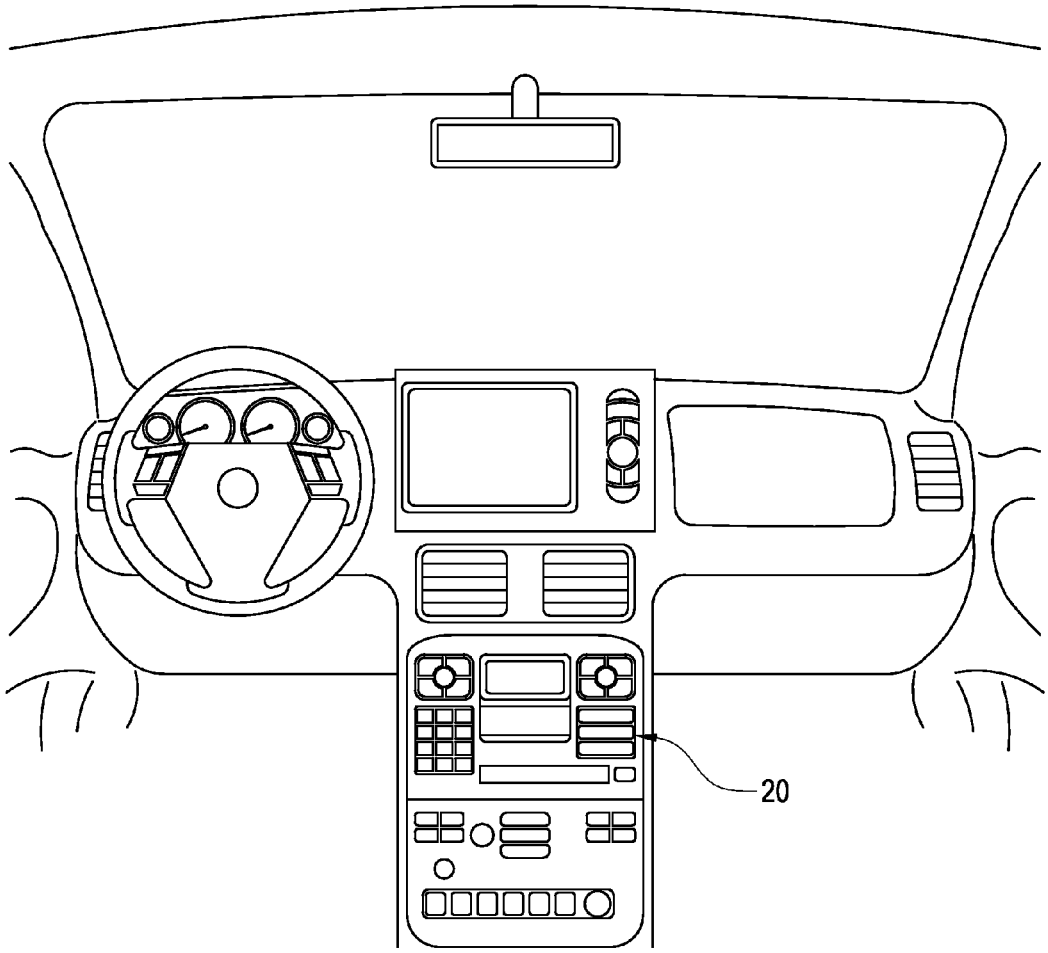
FIG. 9 is a schematic view showing the metallic keypad panel of the present invention being used in an automobile stereo panel.

With reference to FIG. 9, it is a schematic view showing the metallic keypad panel of the present invention being used in an automobile stereo panel. As shown in this figure, in addition to the mobile phone 9 and the personal digital assistant (PDA) 10, the metallic keypad panel assembly of the present invention can be mounted on an automobile stereo panel 20, thereby controlling the operations of an air conditioning system, audio-video system and satellite navigation system.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A metallic keypad panel assembly having a ripple luster, comprising:

a thin plate;

a displaying layer provided on one side surface of the thin plate;

an elastic layer provided on one side surface of the displaying layer and having a carrier thereon, one side surface of the carrier being provided with a plurality of protrusions;

a metallic keypad panel provided on one side surface of the thin plate and having a plate body thereon, the plate body being provided thereon with a first hollowed portion and a second hollowed portion, the first hollowed portion being set as a pressing region, the second hollowed portion being set as an icon on the surface of the pressing region; and a pattern layer provided on one side surface of the metallic keypad panel to seal and fill the first hollowed portion and the second hollowed portion, wherein the pattern layer comprises a pattern formed in a surface of the pattern layer that is spaced apart from the plate body, and the pattern layer is configured for generating a reflective effect of a ripple luster.

2. The metallic keypad panel assembly having a ripple luster according to claim 1, wherein the thin plate is made of polyethylene terephthalate (PET).

3. The metallic keypad panel assembly having a ripple luster according to claim 1, wherein the thin plate is made of polycarbonate (PC).

4. The metallic keypad panel assembly having a ripple luster according to claim 1, wherein the displaying layer is constituted of different colors.

5. The metallic keypad panel assembly having a ripple luster according to claim 1, wherein the elastic layer is made of a rubber material.

6. The metallic keypad panel assembly having a ripple luster according to claim 1, wherein the metallic keypad panel is made of stainless steel (SUS).

7. The metallic keypad panel assembly having a ripple luster according to claim 1, wherein the metallic keypad panel is made of Al—Mg alloy.

8. The metallic keypad panel assembly having a ripple luster according to claim 1, wherein the first hollowed portion has a linear shape and encircles a pressing region via lines.

9. The metallic keypad panel assembly having a ripple luster according to claim 1, wherein the icon comprises any one of numerals, characters, special symbols, dialing icon, ending icon and navigational symbols.

10. The metallic keypad panel assembly having a ripple luster according to claim 9, wherein the special symbol comprises "#", "*", "." etc.

11. The metallic keypad panel assembly having a ripple luster according to claim 1, further comprising an adhesive layer provided between the thin plate and the metallic keypad panel, the adhesive layer allowing the elastic layer to be bound with the metallic keypad panel.

12. The metallic keypad panel assembly having a ripple luster according to claim 1, wherein the pattern layer is made of thermoplastic polyurethane (TPU).

13. The metallic keypad panel assembly having a ripple luster according to claim 1, wherein the pattern layer is made of thermoplastic elastomer (TPE).

14. The metallic keypad panel assembly having a ripple luster according to claim 1, wherein the pattern on the surface of the pattern layer is a spinning.

15. The metallic keypad panel assembly having a ripple luster according to claim 1, wherein the pattern on the surface of the pattern layer is straight lines.

16. The metallic keypad panel assembly having a ripple luster according to claim 1, wherein the pattern on the surface of the pattern layer is a Archimedean screw.

17. The metallic keypad panel assembly having a ripple luster according to claim 1, wherein the pattern layer forms a protective layer for the metallic keypad panel.

18. A metallic keypad panel assembly having a ripple luster, arranged on an electronic device and comprising:

a thin plate;

a displaying layer provided on one side surface of the thin plate;

an elastic layer provided on one side surface of the displaying layer and having a carrier thereon, one side surface of the carrier being provided with a plurality of protrusions;

a metallic keypad panel provided on one side surface of the thin plate and having a plate body thereon, the plate body being provided thereon with a first hollowed portion and a second hollowed portion, the first hollowed portion being set as a pressing region, the second hollowed portion being set as an icon on the surface of the pressing region;

a pattern layer provided on one side surface of the metallic keypad panel to seal and fill the first hollowed portion and the second hollowed portion; and an electroplated layer provided between the metallic keypad panel and the pattern layer.

19. The metallic keypad panel assembly having a ripple luster according to claim 18, wherein the electroplated layer penetrates into the first hollowed portion and the second hollowed portion.

20. The metallic keypad panel assembly having a ripple luster according to claim 19, wherein the electroplated layer is made of a metallic material.

* * * * *